US009022908B2

(12) United States Patent
Crowell et al.

(10) Patent No.: US 9,022,908 B2
(45) Date of Patent: May 5, 2015

(54) EXERCISE DEVICE

(71) Applicant: Hygenic Intangible Property Holding Company LLC, Akron, OH (US)

(72) Inventors: Jason Alan Crowell, Akron, OH (US); Anna Schrock, Wilmington, NC (US); Tanya Loraine Weiker, Lakewood, OH (US); Nevin Dean Gerber, Navarre, OH (US)

(73) Assignee: Hygenic Intangible Property Holding Co., Akron, OH (US)

( * ) Notice: Subject to any disclaimer, the term of this patent is extended or adjusted under 35 U.S.C. 154(b) by 113 days.

(21) Appl. No.: 13/827,445

(22) Filed: Mar. 14, 2013

(65) Prior Publication Data

US 2014/0274601 A1 Sep. 18, 2014

(51) Int. Cl.
*A63B 21/00* (2006.01)
*A63B 21/02* (2006.01)

(52) U.S. Cl.
CPC ..... *A63B 21/028* (2013.01); *Y10S 482/907* (2013.01); *Y10S 482/904* (2013.01)

(58) Field of Classification Search
USPC ..... 482/126, 121, 124, 907, 904
See application file for complete search history.

(56) References Cited

U.S. PATENT DOCUMENTS

| | | | | |
|---|---|---|---|---|
| 4,570,929 | A * | 2/1986 | Shoemaker | 482/125 |
| 5,556,369 | A | 9/1996 | Roberts | |
| 5,571,064 | A | 11/1996 | Holm | |
| 5,624,359 | A * | 4/1997 | Dean | 482/91 |
| 5,816,984 | A | 10/1998 | Weiss | |
| 5,885,190 | A | 3/1999 | Reiter | |
| 6,179,751 | B1 | 1/2001 | Clears | |
| 6,322,483 | B1 | 11/2001 | Rotella | |
| 6,450,929 | B1 | 9/2002 | Markham | |
| 6,726,606 | B2 | 4/2004 | Jacobsen | |
| 6,921,354 | B1 | 7/2005 | Shifferaw | |
| 7,044,896 | B2 | 5/2006 | Hetrick | |
| 7,090,622 | B2 | 8/2006 | Hetrick | |
| 7,438,674 | B2 | 10/2008 | Sjodin | |
| 7,651,451 | B2 | 1/2010 | Jensen | |
| 7,722,508 | B2 | 5/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 7,811,202 | B2 | 10/2010 | Planke | |
| D636,036 | S | 4/2011 | Rios | |

(Continued)

OTHER PUBLICATIONS

International Search Report and Written Opinion mailed Jun. 16, 2014, as received in corresponding International Application No. PCT/US2014/018537.

*Primary Examiner* — Jerome W Donnelly
(74) *Attorney, Agent, or Firm* — Baker and Hostetler LLP

(57) ABSTRACT

An exercise device includes a first elastic material portion having a first face and a second face disposed opposite the first face, a second elastic material portion having a third face and a fourth face disposed opposite the third face, and a plurality of joining regions, wherein the second face of the first elastic material portion attaches to the third face of the second elastic material portion at each joining region. Each joining region is capable of simultaneous multidimensional stretching when subjected to or released from an applied load. An assembly of integrally connected exercise devices includes a first exercise device integrally connected to a second exercise device, wherein a joining region is capable of separation into two smaller joining regions when the first exercise device and the second exercise device are separated.

32 Claims, 3 Drawing Sheets

(56) References Cited

U.S. PATENT DOCUMENTS

| | | | |
|---|---|---|---|
| 8,043,197 | B2 | 10/2011 | Hetrick |
| 8,083,653 | B2 | 12/2011 | Hetrick |
| 8,088,053 | B2 | 1/2012 | Whyatt et al. |
| 8,096,922 | B2 | 1/2012 | Planke |
| 8,197,392 | B2 | 6/2012 | Silverman et al. |
| 8,343,018 | B2 | 1/2013 | Moulton |
| 2004/0067827 | A1 | 4/2004 | Tustin |
| 2007/0027005 | A1 | 2/2007 | Hetrick |
| 2009/0075790 | A1 | 3/2009 | Hetrick |
| 2009/0197747 | A1 | 8/2009 | Chan et al. |
| 2010/0292054 | A1 | 11/2010 | Karpus et al. |
| 2011/0124477 | A1 | 5/2011 | Davis |
| 2012/0202660 | A1 | 8/2012 | Silverman et al. |
| 2013/0059702 | A1 | 3/2013 | Page et al. |

* cited by examiner

EXERCISE DEVICE

FIELD OF THE INVENTION

The present invention generally relates to an exercise device. More particularly, the present invention pertains to an elastic resistive exercise band.

BACKGROUND OF THE INVENTION

Resistive exercising has long been incorporated into athletic training and therapeutic regimens in order to help prevent injury, enhance performance, and rehabilitate muscles after injury or surgery. Conventional isometric or isotonic exercise devices have been used to provide avenues for strength training and muscle therapy without the cost and space required with more bulky equipment. In particular, many types of single loop bands or single strip bands of elastic material have been developed that allow a user to manually exercise based solely on the resistive action provided by the band. For example, the user may exercise with an endless loop band by holding the band toward one end with a hand or a foot and attaching the other end of the band to a stationary object, such as a door, or holding the other end with another hand or foot. Often, in order to obtain and maintain a proper grip on conventional bands, a user must loop the band multiple times around their hand or foot, or tie knots at an appropriate location in the band. These methods to provide effective handles at appropriate locations along a conventional band often result in damage to the band and/or a localized pressure on the hand or foot area, i.e., a cutting in of the band, due to a significant narrowing of the band in and around the area of the knot. To avoid this digging-in effect of the knotted band, the user may rely almost entirely on a finger grip, for example, rather than mounting the band over a larger portion of an extremity, such as a wrist or ankle. Some users, such as the elderly or those with extensive damage to the muscles of the hands or feet, for example, may not be able to effectively grip the bands and thus may deviate from a therapeutic regimen prescribed by a physician to strengthen and/or rehabilitate damaged muscles and/or cause additional injury to themselves. To alleviate this discomfort, some users may rely on special handles that have to be separately attached to the exercise device, resulting in additional cost and complexity that can be discouraging to users.

There is a need for an exercise device that permits easy and efficient use without the need to reconfigure the device with knots or constricting loops, wherein an isotropic nature of the material used to make the device allows the device to easily contour to the shapes of surfaces, providing reduced slip when mounting to various objects, for example, while simultaneously being capable of shaping to the contours of a user's anatomy for added comfort.

SUMMARY OF THE INVENTION

The foregoing needs are met, to a great extent, by the present invention, wherein in some embodiments an exercise device that is capable of overcoming the disadvantages described herein at least to some extent is provided.

The present disclosure provides in some embodiments, a device for exercising muscles that relies on the resistive properties of a material used to produce a series of flexible loops. The device can be formed from strips of elastic material periodically joined at select intervals. More particularly, an exercise device includes a first elastic material portion having a first face and a second face disposed opposite the first face, a second elastic material portion having a third face and a fourth face disposed opposite the third face, and a plurality of joining regions, wherein the second face of the first elastic material portion attaches to the third face of the second elastic material portion at each joining region. Each joining region is capable of simultaneous multidimensional stretching when subjected to or released from an applied load.

In accordance with other aspects of the present disclosure, an assembly of integrally connected exercise devices includes a first exercise device integrally connected to a second exercise device. Each exercise device includes a first elastic material portion, a second elastic material portion, a plurality of joining regions periodically attaching the first elastic material portion to the second elastic material portion, and a plurality of consecutive loops, each loop defining an open space between consecutive joining regions and between the first elastic material portion and the second elastic material portion, wherein each joining region is capable of separation into two smaller joining regions, the first smaller joining region defining a closed end of the first exercise device and the second smaller joining region defining a closed end of the second exercise device when the first exercise device and the second exercise are separated.

In accordance with yet other aspects of the present disclosure, an exercise device includes an elongate strip formed from an elastic material and folded over to form a first portion and a second portion disposed opposite the first portion, and a plurality of joining regions periodically provided along a longitudinal length of the elongate strip to connect areas of the first portion to areas of the second portion and form a plurality of consecutive closed loops.

There has thus been outlined, rather broadly, certain embodiments of the invention in order that the detailed description thereof, herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
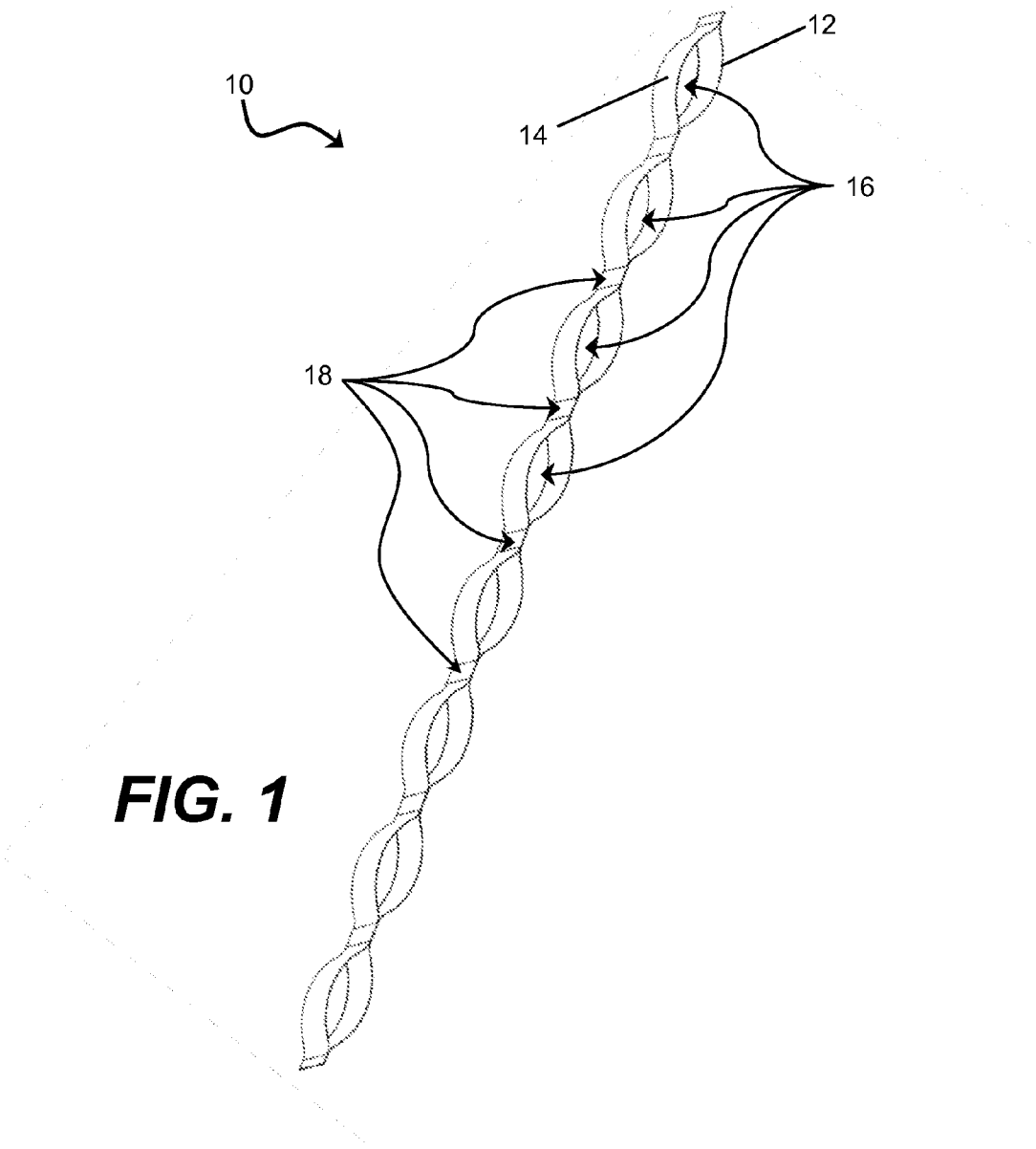
FIG. 1 illustrates a perspective view of an exercise device in accordance with an embodiment of the invention.

The invention will now be described with reference to the drawing figures, in which like reference numerals refer to like parts throughout.

Various aspects of an exercise device may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, if a component is referred to as being "directly coupled", "directly attached", and/or "directly joined" to another component, there are no intervening elements present.

Relative terms such as, for example, "lower" or "bottom", "upper" or "top", "end" or "ends", "face" or "base", may be used herein to describe one element's relationship to another element illustrated in the drawings. It will be understood that relative terms are intended to encompass different orientations of an exercise device in addition to the orientation depicted in the drawings. By way of example, if aspects of an exercise device shown in the drawings are turned over, elements described as being on the "bottom" side of the other elements would then be oriented on the "top" side of the other elements. The term "bottom" can therefore encompass both an orientation of "bottom" and "top" depending on the particular orientation of the apparatus.

FIG. 1 illustrates a perspective view of an exercise device 10, in accordance with aspects of the present invention. The device 10 may include a base portion 12 and a top portion 14. The base portion 12 and top portion 14 may be formed from any suitable natural rubber or synthetic material to impart the material properties discussed herein, such as a thermoplastic elastomeric material that provides a high degree of elasticity, resists tearing, and maintains a desired shape and flexibility when generally at rest even after extensive repetitive stretching.

FIG. 1 also illustrates that the base portion 12 and the top portion 14 may be connected at joining regions along their length, such that a plurality of loops 16 are formed between the base portion 12 and the top portion 14. The loops 16 may be formed by connecting the base portion 12 and the top portion 14 in any suitable fashion, such as, for example, by heat bonding, radio frequency or ultrasonic welding, and/or through use of various adhesive applications. In accordance with yet other aspects of the present disclosure, any suitable tool or device may be used for forming a joining region 18, including brackets, for example, that allows the joining region to have a homogeneous elongation substantially similar to the elongation properties of the other portions of the exercise device 10. As illustrated in the exemplary device 10 in FIG. 1, there are eight loops 16 formed periodically along the length of the device 10, each individual loop 16 being separated by a joining region 18. In accordance with aspects of the present disclosure, there may be between 6 and 12 loops along the length of an exercise device, with each loop 16 being about 6 in. in length when unexpanded, but any suitable number of loops 16 can be used. Additionally, although the loops 16 shown in FIG. 1 are of the same general dimensions, the loops 16 may vary in size individually such that various patterns of varying sized loops 16 may be combined to form an exercise device 10. For example, alternating 4 in. and 6 in. loops 16 or 6 in. loops with a 12 in. center loop may be used.

Figure 2:
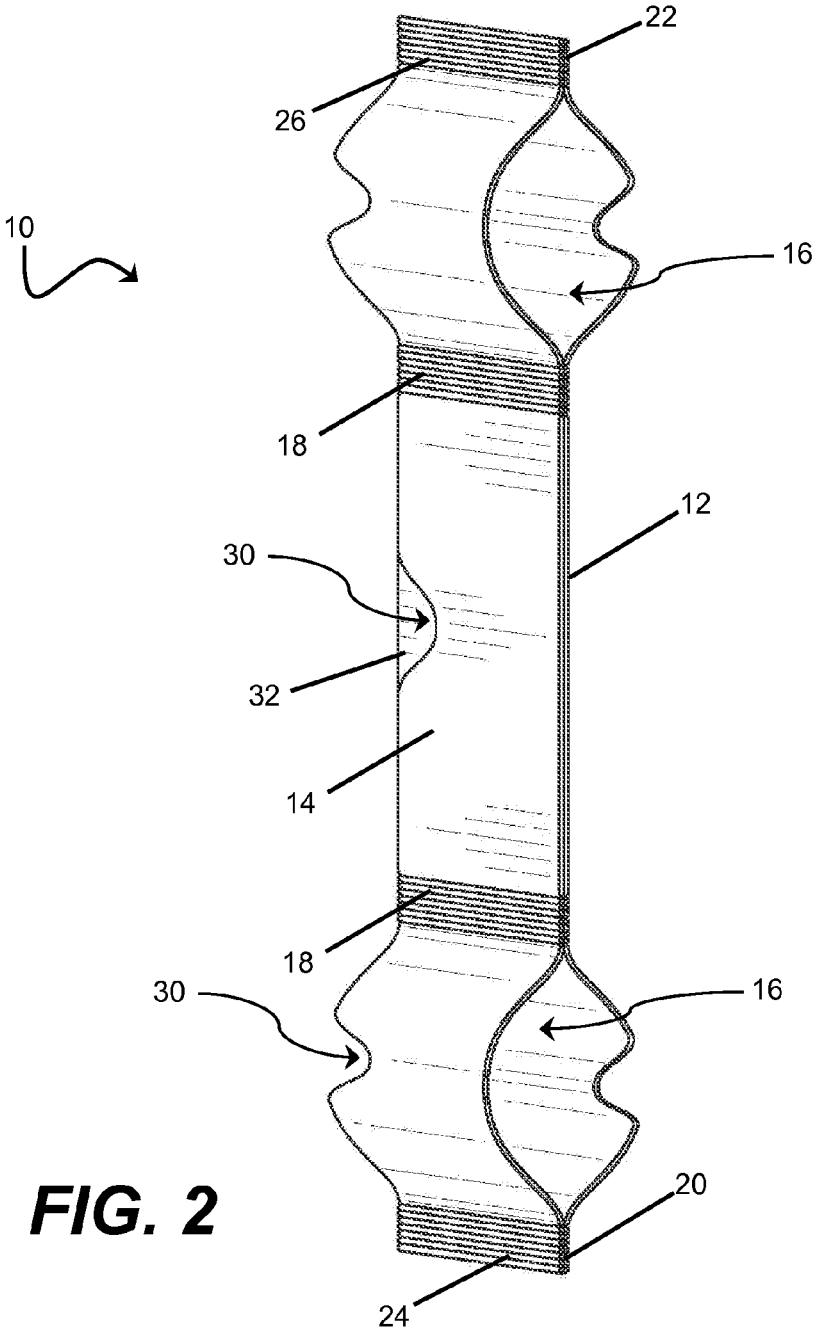
FIG. 2 illustrates an enlarged perspective view of an exercise device in accordance with an embodiment of the invention.
Figure 3:
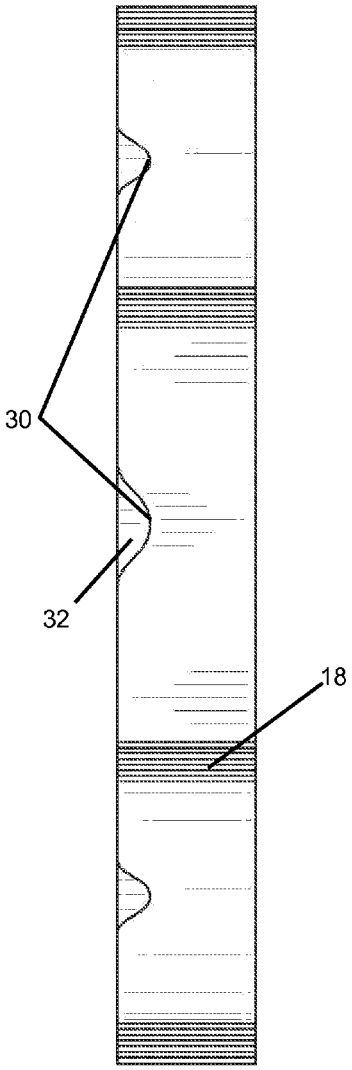
FIG. 3 illustrates a front view of the exercise device shown in FIG. 2, in accordance with an embodiment of the invention.
Figure 4:
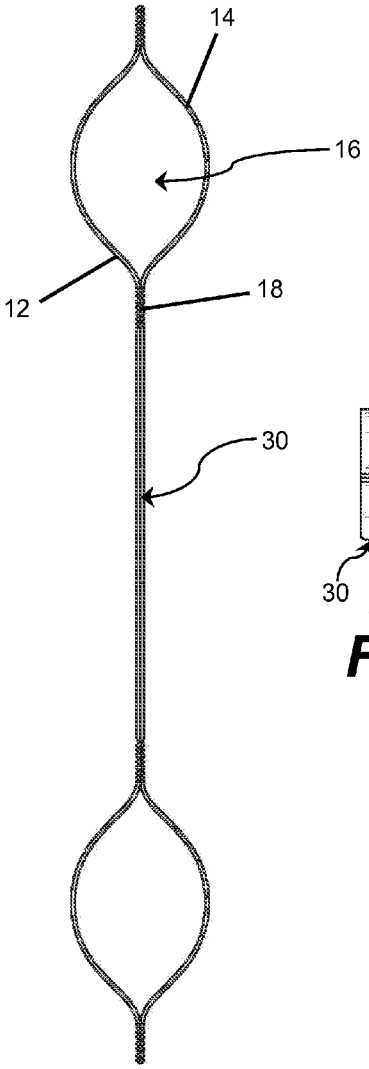
FIG. 4 illustrates a left side view of the exercise device shown in FIG. 3, in accordance with an embodiment of the invention.

FIGS. 2-5 illustrate various views of an enlarged portion of the exercise device 10 to illustrate general concepts that may apply to the device 10 as a whole. For example, although shown as open loops in FIG. 1, FIGS. 2 and 4 illustrate that the loops 16 may lie flat when, for example, the exercise device 10 is in a general state of rest or, in particular, when the exercise device 10 is in a state of use, under tension, and the particular loop 16 is not being used as a loop or handle. Accordingly, when in the closed state, a loop 16 is actually a two-layered feature that provides redundancy in the event of a tear or rips in one of the base portion 12 and the top portion 14. The redundancy provides a measure of safety for the device, preventing injury that might otherwise occur in a unitary design when the single layer of material snaps, unexpectantly releasing resistance during an exercise and/or causing a part of the exercise device 10 to snap toward the user in a dangerous manner. Even in the event of a full tear through the exercise device 10, such as by way of a sharp edge on a stationary support being used with the device, one of the base portion 12 or the top portion 14 will tend to tear first, alerting the user to the situation with only a partial release of the resistive force, enabling the user to avoid serious injury during use. Moreover, the redundant nature of the dual-layered design minimizes in general the impact or "snap-back" of a snapped or released exercise device 10 that may occur during general use.

As shown in FIG. 2, in general, the base portion 12 can be formed from a longitudinal length of elastic material having a first end 20 and a second end 22, and the top portion 14 can also be formed from a second longitudinal length of material having a first end 24 and a second end 26. For example, the process of making the device 10 may include linearly feeding from a spool of material the top portion 14 to overlay the base portion 12 also linearly fed from a second spool of material. The material may be a sheeting material, for example, or a tubing material that is fed longitudinally from the spools. The material used for the base portion 12 and the top portion 14 is preferably the same, however, each portion 12 and 14 may use material having different material characteristics. A bonding process, such as heat sealing or application of an adhesive, may be performed to connect the base portion 12 and the top portion 14 at predetermined intervals, and defining the joining regions 18 of the exercise device 10, which may be spaced at equal intervals or intervals of varied length. In accordance with certain aspects of the present disclosure, the longitudinal area of particular joining regions 18 may be double bonded, for example, at predefined intervals, such as every eighth joining region. Although any joining region may define an area that upon separation forms two ends of two individual exercise devices 10, double-bonding may be used if added strength is desired for the ends of the exercise devices. In some therapeutic regimens, for example, the exercises to be performed may disproportionally rely on using the end loops of the exercise device 10, in which case the added strength imparted by double bonding may be desirable. Doubling the bonded area may increase the strength of the two smaller joining regions forming the ends of the separated exercise devices. Although referred to herein as double-bonding, double-bonding may refer to any increase in the bonding area of a joining region over the bonding area of similar joining regions.

The joining regions 18, which may appear ridged as in FIGS. 2 and 3, may be formed to have any desired appearance in accordance with the configuration of the machining tools.

The ridges may serve to provide visual guidance for cutting or separating the bonded elastic layers devices at one of the joining regions, permitting customization of an exercise device or separation of one exercise device from an assembly of multiple exercises devices.

In accordance with other aspects of the present disclosure, rather than a ridged crimping tool, a crimping tool may be used that provides for any suitable smooth, textured, and/or embossed surface appearance. The material of the base portion 12 and the top portion 14 may be configured to have a smooth, textured, and/or embossed surface appearance.

In accordance with yet other aspects of the present invention, large spools, rolls or folded stacks, for example, of a series of connected exercise devices 10 may be provided, whereupon a practitioner may individually remove an individual exercise device 10 from the assembly by cutting through one of the joining regions 18 at a desired length. The practitioner may thus control the individual length of each exercise device 10 to suit a particular user's needs while maintaining a compact arrangement for storage. Alternately, the spool length of connected exercise devices 10 may be scored along joining regions 18 at particular lengths to enable easy and efficient removal of an individual exercise device 10 from the larger collection of spooled exercise devices.

Figure 5:
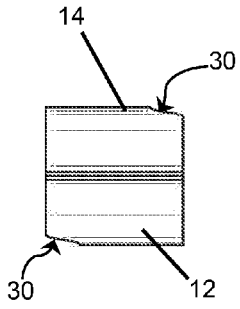
FIG. 5 illustrates a top view of the exercise device shown in FIG. 2, in accordance with an embodiment of the invention.

As shown in FIG. 2, a notch 30 may be provided along one or both longitudinal sides of the base portion 12 and/or top portion 14 between consecutive joining regions 18. Each notch 30 corresponds to an unnotched region 32 in the opposing base portion 12 or top portion 14. In this manner, a user may easily grip the unnotched region 32 in order to separate the base portion 12 from the top portion 14 to form a loop 16. Although shown to be parabolic in shape, the notch 30 may be formed in any shape that creates an aesthetically pleasing appearance when viewed in the context of the overall appearance of the exercise device 10. The notch 30 may be centered along a particular longitudinal side of the base or top portions, with one notch 30 formed on one side of the device 10 in the base portion 12 and another notch 30 formed on the opposing side of the device 10 in the top portion 14, as shown in FIG. 5. In accordance with yet other aspects of the present invention, the notch or notches 30 may be formed at any point along the longitudinal sides of the base and top portions 12 and 14 respectively.

The consecutive loops 16 on the exercise device 10 allow for quick positioning of the device 10 when mounting the device to an object, for example. Rather than having to tie the device 10 around an object, one end of the device 10 may be quickly wrapped around a suitable mounting portion of the object and routed through one of the loops 16, preferably near the other end of the device 10. Continued pulling on the first end of the device 10 may then simply cinch a portion of the device 10 closed around the mounting portion of the stationary object. To quickly remove the exercise device 10, the user simply releases the active end of the device 10 and pulls on the loop 16 through which the exercise device 10 was originally threaded. The threaded loop 16 eventually disengages the active end and releases the active end to freely dismount the exercise device 10 from the object.

A user generally relies on the resistive nature of the material used to construct the base portion 12 and top portion 14 of the exercise device 10. In this manner, the base portion 12 and/or top portion 14 may be composed of an elastic material having a certain thickness and/or that is dimensioned to impart a particular range of resistance to a user exercising with the device. In this manner, an identification system may be used to indicate a series of exercise devices having progressive levels of resistance. For example, a system of numbers, colors, letters, symbols, patterns, or any other appropriate marking may be used to indicate a system of exercise devices having progressive levels of resistance.

In accordance with other aspects of the present invention, the elastic material used to construct the base portion 12 and top portion 14 may be an isotropic material capable of stretching similarly in any direction. The isotropic nature of the material allows the material to easily contour to the shapes of surfaces, providing better grip when mounting to various objects, for example, while simultaneously being capable of shaping to the contours of a user's anatomy. The isotropic material may thus provide a more effective and comfortable resistive type exercise apparatus, and allow a greater range of exercises to be performed using the device.

In addition, the elastic nature of the material provides for a homogeneous stretch and recovery of loaded portions of the exercise device, the material stretching similarly under an applied load across both the joining regions and loops to provide a consistent progression for the user without a bottoming out or abrupt stop that is often experienced when using a conventional exercise device. For example, conventional exercise devices comprising a fabric component in combination with elastic webbing experience a specific endpoint limitation due to the inelastic nature of the fabric material, causing the abrupt stop or bottoming out sensation that can be uncomfortable to a user and limiting the range of exercises that can be performed using the device. During recovery, the nature of the elastic material of the present invention providing a consistent elongation across the joining regions and the loops allows for a smooth and consistent recovery of the exercise device back toward the rest state. Furthermore, exercise devices based on a fabric component are subject to an increased wear of the fabric material, which can change the intended level of resistance and the consistency of elongation over time with respect to the exercise device. In addition, fabric based devices are often much more slippery making mounting the device on an object in accordance with the methods disclosed herein much more dangerous and less effective for performing a broader range of exercises.

Although the exercise device 10 may be mounted to a stationary object, such as a door handle, for example, the exercise device 10 may also be cinched in the manner described above around a user's torso, for example, or various portions of the legs and arms. In this manner, a user may be free to quickly and efficiently use the exercise device 10 in a wide variety of ways to perform a wide variety of resistance type exercises. In addition, by providing a series of consecutive loops 16, the exercise device 10 provides multiple positions for gripping the exercise device 10, reducing the need for a wide variety of exercise device 10 lengths to accommodate the many different anatomical dimensions for a wide array of users. In addition, the smaller radius of curvature of the consecutive loops 16 provided on the exercise device, when compared to a traditional endless loop band, for example, provides a generally more secure grip when the loop 16 is used during any range of exercises.

Other advantages of the exercise device 10 include that use of the loops 16 of the exercise device 10 are more intuitive to an unfamiliar user when compared to an endless open band, for example. Moreover, a user may more easily use the loops 16 to appropriately grip the exercise device 10 without having to tie knots in the device, knots that can apply substantial digging pressure due to the applied pressure of a narrowed band material against a user's body. The user may rely on the open sides of a loop 16 to more naturally and ergonomically mount the exercise device on a hand, foot, wrist, ankle, or any other suitable portion of a user's body, and to use the exercise device 10 comfortably and efficiently and in accordance with instructions. The ease of use and efficiencies realized through use of the exercise device 10 may permit users to more quickly move through a series of exercises or routines, which may result in increased user compliance and higher sustained heart rate.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to falling within the scope of the invention.

What is claimed is:

1. An exercise device comprising:

a first elastic material portion having a first face and a second face disposed opposite the first face;

a second elastic material portion having a third face and a fourth face disposed opposite the third face; and a plurality of joining regions, wherein the second face of the first elastic material portion attaches to the third face of the second elastic material portion at each joining region of the plurality of joining regions, and wherein each joining region is capable of simultaneous multidimensional stretching when subjected to or released from an applied load.

2. The exercise device of claim 1, wherein the joining regions are formed by adhesively bonding the first elastic material portion to the second elastic material portion.

3. The exercise device of claim 1, wherein the joining regions are formed by heat bonding the first elastic material portion to the second elastic material portion.

4. The exercise device of claim 1, further comprising a joining device attached to the exercise device to form at least one of the joining regions.

5. The exercise device of claim 1, wherein the elastic material comprises at least one of natural rubber, thermoplastic elastomer, or synthetic material.

6. The exercise device of claim 1, wherein a plurality of consecutive loops are defined by the joining regions as open spaces between the first elastic material portion and the second elastic material portion, and wherein when the exercise device is subjected to an applied load, the loops and joining regions subjected to the applied load undergo a substantially homogeneous elongation.

7. The exercise device of claim 6, wherein at least one of the plurality of consecutive loops is capable of attaching to a stationary object while at least one other of the plurality of consecutive loops is held by a user.

8. The exercise device of claim 6, wherein the plurality of consecutive loops comprises 8 to 11 loops.

9. The exercise device of claim 6, wherein the plurality of consecutive loops includes loops of at least two different sizes.

10. The exercise device of claim 9, wherein a first size is approximately 6inches and a second size is approximately 12 inches and the plurality of consecutive loops includes a plurality of loops of the first size divided evenly by a center loop of the second size.

11. The exercise device of claim 1, wherein each joined region comprises a series of transverse ridges.

12. The exercise device of claim 6, wherein at least one loop includes a notched portion fonned in the first elastic material portion and/or the second elastic material portion between consecutive joining areas.

13. The exercise device of claim 1, wherein the elastic material is an elongate sheeting material.

14. The exercise device of claim 1, wherein the elastic material is an elongate tubing material.

15. The exercise device of claim 1, wherein the elastic material is an isotropic material capable of at least 400% elongation along a longitudinal length of the exercise device without reaching an elastic limit.

16. An assembly of integrally connected exercise devices, the assembly comprising: a first exercise device integrally connected to a second exercise device, each exercise device comprising:

a first elastic portion;

a second elastic portion;

a plurality of joining regions periodically attaching the first elastic portion to the second elastic portion; and a plurality of consecutive loops, each loop defining an open space between consecutive joining regions and between the first elastic portion and the second elastic portion;

wherein each joining region is capable of separation into two smaller joining regions, the first smaller joining region defining a closed end of the first exercise device and the second smaller joining region defining a closed end of the second exercise device when the first exercise device and the second exercise are separated.

17. The assembly of claim 16, wherein each joining region is formed by adhesively bonding a portion of the elastic first band portion to a portion of the elastic second band portion.

18. The assembly of claim 16, wherein each joining region is formed by heat bonding a portion of the elastic first band portion to a portion of the elastic second band portion.

19. The assembly of claim 16, wherein the plurality of integrally connected exercised devices are assembled in a rolled configuration.

20. The exercise device of claim 16, wherein the elastic material is an elongate sheeting material.

21. The exercise device of claim 16, wherein the elastic material is an elongate tubing material.

22. An exercise device comprising:

an elongate elastic material folded over to form a first portion and a second portion disposed opposite the first portion; and a plurality of joining regions periodically provided along a longitudinal length of the elongate elastic material to connect areas of the first portion to areas of the second portion and forming a plurality of consecutive closed loops, wherein at least one end loop of the closed loops includes a plurality of joining regions.

23. The exercise device of claim 22, wherein the plurality of joining regions are formed by adhesive bonding.

24. The exercise device of claim 22, wherein the plurality of joining regions are formed by heat bonding.

25. The exercise device of claim 22, further comprising a joining device attached to the exercise device to form at least one of the joining regions.

26. The exercise device of claim 22, wherein the elastic material comprises at least one of natural rubber, thermoplastic elastomer, or synthetic material.

27. The exercise device of claim 22, wherein the plurality of consecutive loops includes loops of at least two different sizes.

28. The exercise device of claim 27, wherein a first size is approximately 6inches and a second size is approximately 12 inches and the plurality of consecutive loops includes at least a center loop of the second size.

29. The exercise device of claim 22, wherein the elastic material is an isotropic material capable of at least 400% elongation along a longitudinal length of the exercise device without reaching an elastic limit.

30. The exercise device of claim 22, wherein the joined region comprises a series of transverse ridges.

31. The exercise device of claim 22, wherein the elastic material is an elongate sheeting material.

32. The exercise device of claim 19, wherein the elastic material is an elongate tubing material.

* * * * *